United States Patent [19]

Zavaras et al.

[11] 4,042,007

[45] Aug. 16, 1977

[54] CONTINUOUS CASTING OF METAL USING ELECTROMAGNETIC STIRRING

[75] Inventors: Alexander A. Zavaras, Athens, Greece; Robert Sobolewski, Streetsboro; Cecil B. Griffith, North Royalton, both of Ohio

[73] Assignee: Republic Steel Corporation, Cleveland, Ohio

[21] Appl. No.: 571,016

[22] Filed: Apr. 22, 1975

[51] Int. Cl.[2] ..... B22D 27/02; B22D 11/10

[52] U.S. Cl. ..... 164/49; 164/66; 164/82; 164/147; 164/281 R

[58] Field of Search ..... 164/49, 66, 68, 82, 164/147, 250, 281; 222/566, 567, 598, 600, 603, 604, 606, 607

[56] References Cited

U.S. PATENT DOCUMENTS

| | | | |
|---|---|---|---|
| 3,517,726 | 6/1970 | Mills et al. | 164/281 |
| 3,608,621 | 9/1971 | Bollig et al. | 164/281 |
| 3,693,697 | 9/1972 | Tzauaras | 164/82 X |
| 3,703,924 | 11/1972 | Whisler et al. | 164/281 X |
| 3,804,147 | 4/1974 | Babel et al. | 164/49 |
| 3,811,490 | 5/1974 | Middleton et al. | 164/66 X |
| 3,886,992 | 6/1975 | Maas et al. | 164/66 X |

FOREIGN PATENT DOCUMENTS

| | | | |
|---|---|---|---|
| 2,062,114 | 7/1972 | Germany | 164/281 |
| 236,058 | 5/1945 | Switzerland | 164/273 |

*Primary Examiner*—Ronald J. Shore
*Assistant Examiner*—Gus T. Hampilos
*Attorney, Agent, or Firm*—Cooper, Dunham, Clark, Griffin & Moran

[57] ABSTRACT

In continuous casting of metal in an open-ended mold through which the metal is advanced in a first direction while undergoing peripheral solidification, and to which molten metal is supplied by a shroud that opens beneath the metal level, use of a shroud having an axial nozzle and terminating in a well beyond the nozzle, with lateral discharge ports between the well and the nozzle oriented to discharge the supplied metal at an obtuse angle to the first direction, assists in reducing the incidence of entrapped inclusions. Injection of inert gas into the flow of molten metal within the shroud promotes transport of inclusions in the second direction within the mold. The shroud and/or inert gas injection may be employed in combination with the provision of electromagnetically produced metal circulation in the mold causing flow of molten metal, in a second direction opposite to the first direction, along the solid-liquid interface within the mold for preventing entrapment of inclusions at the interface.

10 Claims, 7 Drawing Figures

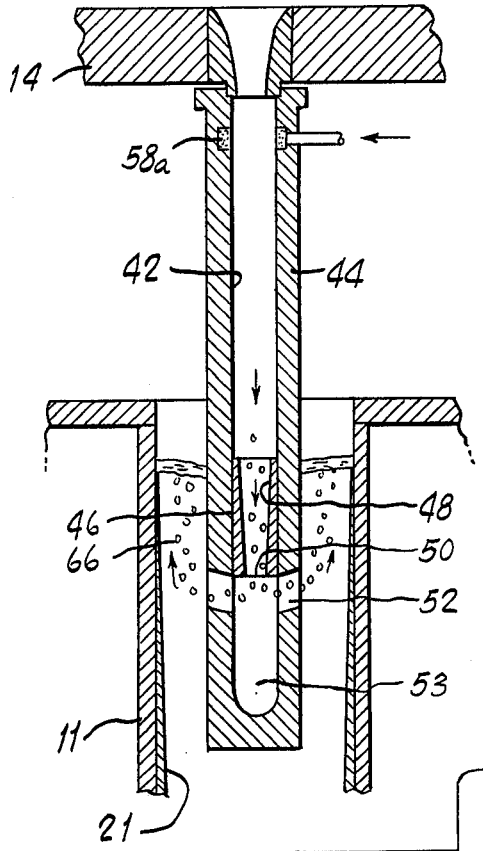
Fig. 5.
Fig. 7.
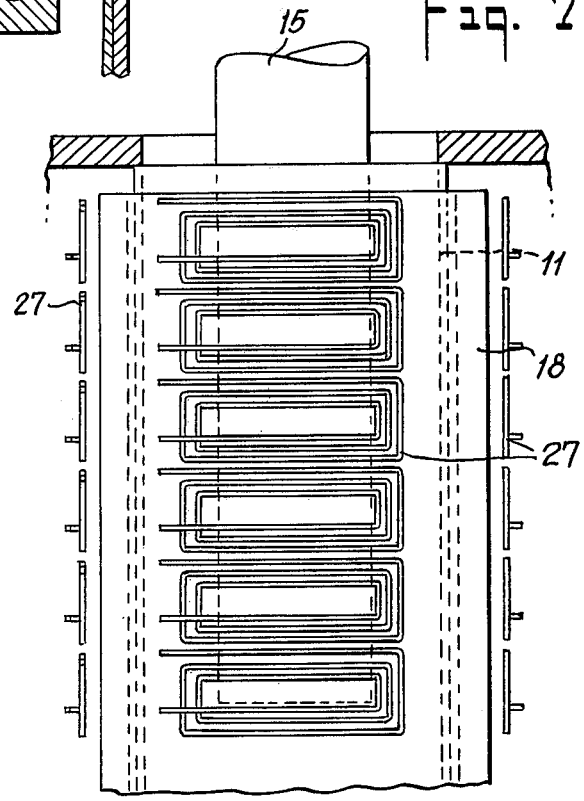
Fig. 6.
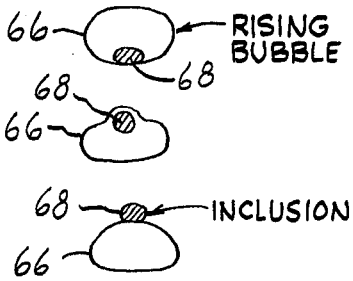

CONTINUOUS CASTING OF METAL USING ELECTROMAGNETIC STIRRING

BACKGROUND OF THE INVENTION

This invention relates to procedures and apparatus for the continuous casting of metals.

More particularly, the invention is directed to continuous casting operations of the type wherein the metal being cast is progressively advanced through a chilled and open-ended mold while undergoing peripheral solidification to provide a solid outer shell for the emerging cast body, which typically has a molten core extending for some distance beyond the mold. Additional positive cooling is commonly applied to the body beyond the mold to promote solidification of the core. In the casting operations with which the present invention is most specifically concerned, molten metal is progressively supplied to the mold (as casting proceeds) from a tundish or the like through a so-called submerged shroud, i.e. a conduit or tube that has discharge ports submerged beneath the molten metal level in the mold.

A familiar example of such operations, to which detailed reference will be made herein for purposes of illustration, is the casting of steel billets in an axially vertical mold having a coaxially disposed shroud projecting downwardly into the mold.

In these and other casting operations, inclusions such as oxide particles are unavoidably present in the delivered molten metal. Desirably, the inclusions thus introduced are carried into the slag layer floating on the molten metal surface in the mold during casting. It is found, however, that even though the inclusions are lower in specific gravity than the metal, a proportion of them tend to become entrapped at the solid-liquid interface within the mold. Consequently, the cast billet may contain significant quantities of these inclusions, especially in its outer portion, which corresponds to the locus of the solidification front at the region within the mold where the entrapment occurs. Material from the slag layer may also be entrapped as inclusions in the outer portion of the billet. Apart from the general undesirability of incorporating contaminant matter in a cast billet, the occurrence of such inclusions, e.g. alumina, presents a serious specific problem in that it interferes with machinability of the billet, since the outer portion of the billet is commonly subjected to machining.

Stated in other words, it would be very desirable to minimize or prevent entrapment of inclusions, whether from the introduced flow of molten metal or from the slag layer, at the solid-liquid interface of a body being cast within a continuous casting mold.

Various expedients have heretofore been suggested for dealing with these and other problems associated with conventional continuous casting practice. For instance, it has been proposed to provide a shroud having lateral discharge ports oriented to direct the flow of supplied molten metal obliquely upwardly within a mold. In operations not employing a shroud, it has also been proposed to deliver molten metal to the mold within a surrounding sleeve of inert gas, or to create, by electromagnetically produced molten metal circulation, an upward flow of metal adjacent the periphery of an axially vertical mold. These expedients, however, have not afforded wholly satisfactory reduction of inclusions in the outer portion of cast billets, or have suffered from other disadvantages. In particular, it has been difficult to produce fluid circulation electromagnetically within a mold, because the coils through which electric current is passed to cause such circulation must be disposed externally of the electrically conductive wall of the mold, although (as described in U.S. Pat. No. 3,693,697, issued Sept. 26, 1972 to Alexander A. Tzavaras, one of the applicants herein) effective circulation can be produced electromagnetically in the molten core of the portion of a billet that projects beyond a mold, for control of solidification conditions within that portion.

SUMMARY OF THE INVENTION

It is an object of the present invention to provide improvements in continuous casting procedures and apparatus of the type wherein metal to be cast is delivered to a mold through a submerged shroud. A further object is to provide such improvements for reducing the occurrence of inclusions in a cast body and especially in the outer portion thereof corresponding to the locality of the solid-liquid interface within the mold.

Stated broadly, the invention is applicable to the continuous casting of metal wherein liquid metal is poured through a submerged shroud into a cooled mold through which the metal moves in a first direction with an outer solidifying shell defining a solid-liquid interface within the mold and which is lined with electrically conductive material, the shroud having a closed bottom and delivering metal to exit outwardly into a region located in an upper portion of the mold. In procedures in accordance with the invention, the metal is poured through the shroud so as not to interfere with the slag layer floating in contact with the metal substantially upstream of the bottom region of the shroud.

In a copending United States patent application, Ser. No. 571,017, filed concurrently herewith by applicants herein jointly with Robert E. Ryan and Michael E. George for Continuous Casting of Metals, and assigned to the same assignee as the present application, there is disclosed and claimed a casting procedure which contemplates electromagnetically producing circulation in the liquid metal in the mold by passing alternating current, preferably in one or more generally horizontal, helical paths, running along the mold between approximately the slag-metal interface and a locality situated downstream of the outward exit of metal from the shroud. The alternating current is supplied to have at least two successively different phases in longitudinally successive regions thereby to provide circulation of the liquid metal in a second direction generally opposite to the aforementioned first direction along the solid-liquid interface within the mold from the last-mentioned locality to the slag layer, and generally in the first direction along the outer surface of the shroud. Further, the alternating current is supplied at a frequency sufficiently high to move the metal in the described circulation and sufficiently low that effective metal-moving power is transmitted despite attenuation by the conductive lining such that electromagnetically induced metal flow acts to positively sweep nonmetallic inclusions entrained in the outflow from the shroud along the solid-liquid interface in spaced relation thereto toward the slag layer.

In this procedure, the electromagnetically created flow of molten metal, directed toward the slag layer along the solid-liquid interface within the mold, both promotes transport of inclusions (introduced with the metal delivered through the shroud) toward the slag layer, and also, very significantly, serves as a shield or screen to prevent these inclusions from reaching the solid-liquid interface, where they would tend to become entrapped in the mushy solidifying metal. That is to say, not only the direction of the flow, but also the fact that it keeps the inclusions spaced away from the interface as they move toward the slag layer, is important for minimizing or preventing entrapment of inclusions in the metal body being cast. In addition, the direction of the flow adjacent the periphery of the slag layer (i.e. that part of the slag layer which is closest to the solid-liquid interface) inhibits entrapment of slag material. Thus the described procedure results in significant reduction of inclusions in the cast body and enhanced surface quality of the cast body.

The present invention, in a first aspect, contemplates provision of a special shroud structure having a bore which tapers in the first direction to form an axially oriented submerged nozzle, and terminates in a well which opens toward the nozzle and has an axial dimension equal to at least several times the diameter of the nozzle. Between the nozzle and well are provided a plurality of lateral ports oriented to discharge metal into the mold at an obtuse angle to the first direction, i.e. so that the discharged metal flows obliquely toward the slag layer. In use of this shroud, the nozzle directs the introduced metal toward the relatively deep well which defines a mixing zone and a buffer chamber preventing violent splashing of liquid metal into the mold; the described shroud features also provide desired conditions for directing flow of the introduced metal (with the inclusions toward the slag layer. Consequently, inclusions tend to collect in the slag layer rather than to be entrapped at the solid-liquid interface, and at the same time the flow of freshly introduced hot metal toward the slag layer helps to keep that layer in a heated and fluid condition as desired to minimize slag entrapment in the body being cast.

The described shroud embodies important apparatus features of the present invention, and (further in accordance therewith) its use may also be combined, with special advantages, with the procedure of the aforementioned copending application including electromagnetically produced circulation as set forth above. In such combination, the flow conditions created by the shroud structure cooperate with the electromagnetically produced metal flow to carry introduced inclusions into the slag layer (where they accumulate for convenient removal without contaminating the cast body) while shielding the solid-liquid interface in the mold so that inclusions do not reach the interface, and also cooperate to minimize or prevent entrapment of slag in the cast body.

In still another aspect, the invention contemplates injecting an inert gas into the flow of molten metal at an upstream location in the shroud. The gas is finely dispersed in small bubbles which rise rapidly to the slag layer as soon as the metal exits from the shroud, providing a vehicle for transporting inclusions to the slag. Again, this feature of the invention may advantageously be combined with those described above for achieving preferential incorporation of inclusions in the slag layer and minimizing occurrence of inclusions in the cast body.

Further features and advantages of the invention will be apparent from the detailed description hereinbelow set forth, together with the accompanying drawings.

BRIEF DESCRIPTION OF THE DRAWINGS

FIG. 5 is a view of a modified form of the shroud structure of the invention;

FIG. 6 is a view in illustration of the effect of inert gas bubbles in transporting inclusions toward the slag layer in the mold; and FIG. 7 is a simplified elevational view of a mold similar to that of FIG. 1, showing an alternative arrangement of coils for producing electromagnetic circulation e.g. in the apparatus of FIG. 1.

DETAILED DESCRIPTION

Figure 1:
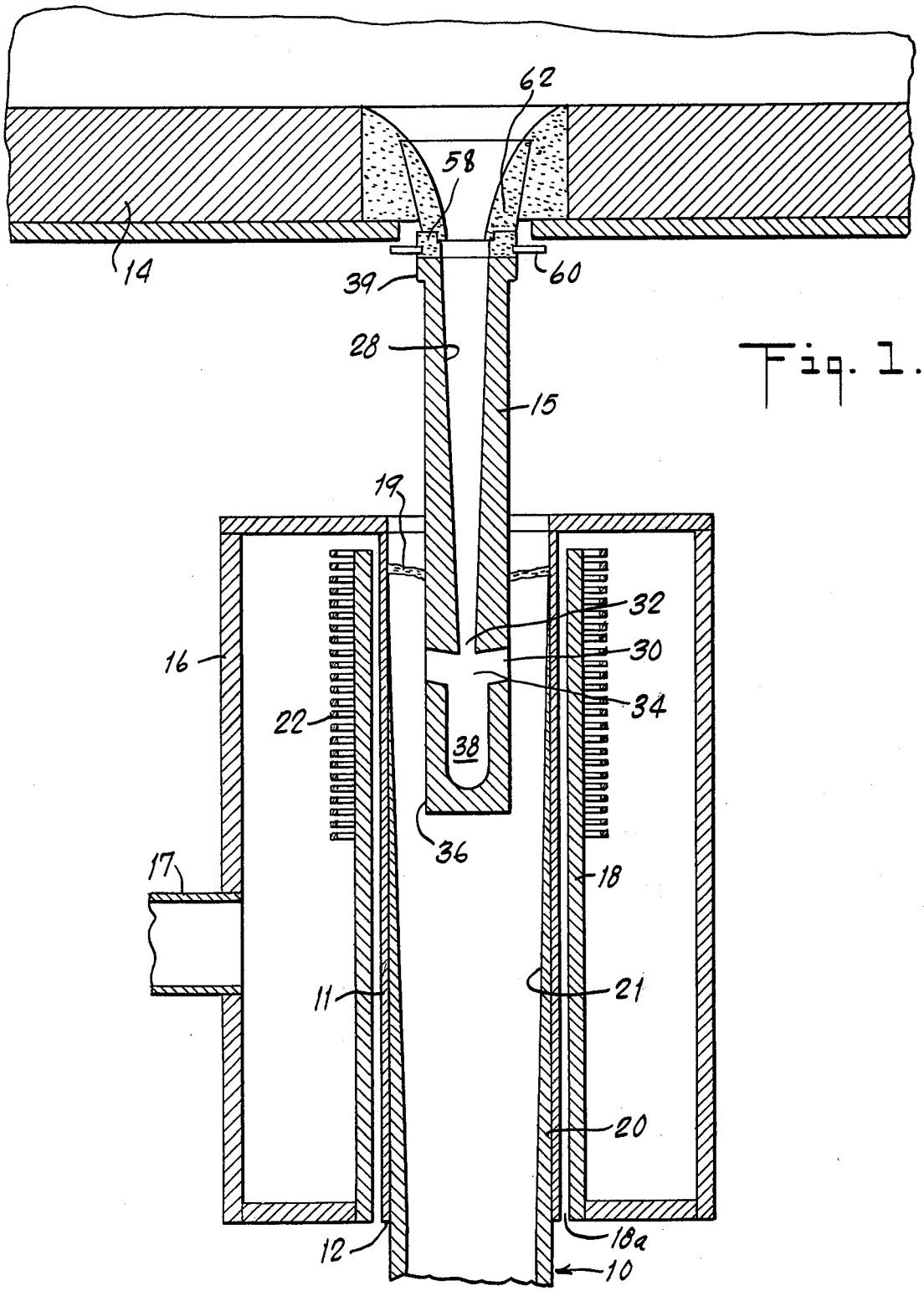
FIG. 1 is a sectional elevational view of representative apparatus in accordance with the invention.

For purposes of specific illustration, the invention will be described with reference to the continuous casting of a steel billet 10 (FIG. 1) in an axially vertical mold 11 having an open lower end 12 through which the billet is progressively advanced, i.e. in a downward direction, as casting proceeds, while molten steel is progressively supplied to the interior of the mold as from a tundish 14 by means of a submerged shroud 15. In common with conventional arrangements for continuous casting, the mold 11 may comprise a copper wall defining a casting region conforming in cross section to the desired circular, square, rectangular or other cross-sectional shape and dimensions of the billet to be cast. Outwardly of the mold 11, there is provided a stainless steel cooling jacket 16 through which a coolant liquid such as water is circulated to chill the mold; the liquid, supplied to the jacket through a conduit 17, flows downwardly through a space defined between the mold wall and a surrounding baffle portion 18 of the jacket, to exit through a downwardly opening slit **18*a* surrounding the open lower end 12** of the mold. Appropriate structures and techniques for performing such aspects of the operation as start-up, cooling of the emergent billet below the mold, and progressive controlled descent of the billet from the mold during casting, may be generally conventional as will be apparent to those skilled in the art and accordingly need not be described in detail. It will be understood, of course, that the foregoing features are merely illustrative of one type of casting operation with which the present invention may be practiced.

In the described casting operation, molten metal is delivered through the shroud 15, at a rate to maintain the mold filled with metal to a substantially constant level in the upper portion of the mold, i.e. spaced above the submerged discharge ports of the shroud; a layer 19 of slag floats on the surface of the molten metal in the mold. Solidification of the metal, promoted by the chilling effect of the supplied coolant, commences at the periphery of the body of metal within the mold and proceeds progressively inwardly (as the metal advances downwardly) toward the axis thereof, providing a solid external shell 20 for the billet at and below the lower end of the mold, although the core of the billet remains molten for a substantial distance below the mold. Thus, in the body of metal within the mold, there is a solid-liquid interface or solidification front 21 which tapers gradually inwardly (in a downward direction) through and below the mold. Typically, at the region of molten metal delivery in the mold, the position of this interface corresponds to a locality fairly close to the periphery of the ultimately cast ingot.

The molten metal as delivered through the shroud unavoidably contains inclusions such as solid particles of aluminum oxide, which are usually carried in the flow of metal exiting from the shroud discharge ports. It is desirable that these inclusions rise to and accumulate in the slag layer 19, so that they will not contaminate the cast billet. At the solid-liquid interface 21, however, there is a "mushy zone" of solidifying metal which tends to entrap and retain any solid inclusions that come into contact with it. Therefore, to the extent that inclusions entering the mold from the shroud are carried to the mushy zone by the incoming metal flow, they are very likely to become entrapped at the interface 21 rather than rising to the slag layer; material of the slag layer may also become entrapped as inclusions at the interface. The entrapped inclusions remain in and contaminate the cast billet, at the locations (relative to the billet axis) at which they are intitially entrapped, undesirably impairing the machinability of the billet and especially the outer portion thereof (which is commonly subjected to machining) where these inclusions are found.

The present invention, as employed in a casting operation of the above type, embraces means and procedures having particular effectiveness for minimizing entrapment of such inclusions. Thus, for practice of the procedure of the aforementioned copending application in combination with other features of the present invention, electromagnetic induction stirring coils 22 are provided in surrounding relation to the upper portion of the mold 11 and alternating current is passed therethrough to provide a particular advantageous flow pattern in the molten metal in that region of the mold. In accordance with the present invention, a shroud of special construction is employed; and, as an additional feature of the invention, an inert gas is injected into the incoming stream of molten metal at an upstream locality in the shroud. Each of these features may be employed individually, or (with special advantage) in combination with other features of the invention, to achieve the desired object. Specifically, it will be understood that the present invention embraces the special shroud and gas-injection features and also the various combinations thereof with each other and with the stirring procedure of the aforementioned copending application. These several aspects of the invention will now be described in detail in exemplary and presently preferred embodiments.

ELECTROMAGENTICALLY CREATED CIRCULATION

For the practice of the procedure of the aforementioned copending application, with the apparatus of FIG. 1, the helical coils 22 are disposed within the cooling jacket 16 in proximate surrounding coaxial relation to the upper portion of the mold 11, i.e. that portion of the mold through which the shroud 15 extends. These coils provide generally horizontal helical paths for alternating current, running peripherally around the mold between approximately the slag-metal interface and a locality situated downstream of the outward exit of metal from the shroud. The coils 22 are energized by a source of alternating current potential (not shown) such that the excitation of different sections or portions of the coils in longitudinally successive regions differs successively in phase in a predetermined manner as will be readily understood. Any number of phases (i.e. two or more) may be employed for the excitation. What is desired is a moving magnetic field which causes a flow of metal as shown by arrows 24 in FIG. 3.

In this regard, it will be appreciated that electromagnetic stirring principles as employed in connection with the melting and refining of molten metal are well known, and that the procedure of the aforementioned copending application involves a specific application of these general principles. Thus, stated in general, the stirring mechanism involves the development of eddy currents within the molten metal by a varying magnetic field, which eddy currents themselves set up magnetic fields that interact with the applied magentic field to cause movement of the molten metal. By using polyphase excitation of portions or sections of the coils 22 located at different positions along the mold axis, pulses of motive force are given to the molten metal progressively from section to section in the desired direction, so that the metal is caused to flow continuously upward along its outermost region (immediately adjacent the solid-liquid interface), in effect parallel to the axis of the coils. Accordingly, the flow of molten metal is as shown by the arrows 24, namely, sweeping upwardly over the solid-liquid interface within the mold, and downwardly along the outer surface of the shroud.

More particularly, the procedure of the aforementioned copending application involves passing alternating current through the coils, i.e. current having at least two successively different phases in longitudinally successive regions of the coils, at a frequency sufficiently high to move the metal in the described circulation and sufficiently low that effective metal-moving power is transmitted despite attenuation of the conductive metal wall or lining of the mold 11. As will be understood, the copper mold wall significantly attenuates stirring power, but the extent of such attenuation is inversely related to frequency, as indicated by the following table which sets forth experimentally determined values for percentage attenuation and percentage transmittal of stirring power through a copper mold wall at frequencies ranging from ½ to 60 Hertz, using three-phase current:

| Frequency (Hz) | % Attenuation | % Transmittal |
|---|---|---|
| ½ | 0 | 100 |
| 10 | 38 | 62 |
| 15 | 57 | 43 |
| 20 | 63 | 37 |
| 25 | 71 | 29 |
| 30 | 73 | 27 |
| 35 | 75 | 25 |
| 60 | 85 | 15 |

As will be apparent from the foregoing table, if the frequency of the supplied alternating current is too high, the attenuation is so great that impracticable input levels would be required to achieve effective metal stirring within a mold. On the other hand, it is found that even at substantial input power levels, effective metal circulation is not achieved if the frequency is excessively low. It is preferred to use a frequency of less than 60 Hz in the present method, an especially preferred and effective frequency range for the supplied alternating current being between about 10 and about 35 Hz. Within such range, the frequency is sufficiently high and the attenuation adequately low to permit attainment of the desired circulation at economical levels of supplied power.

Figure 3:
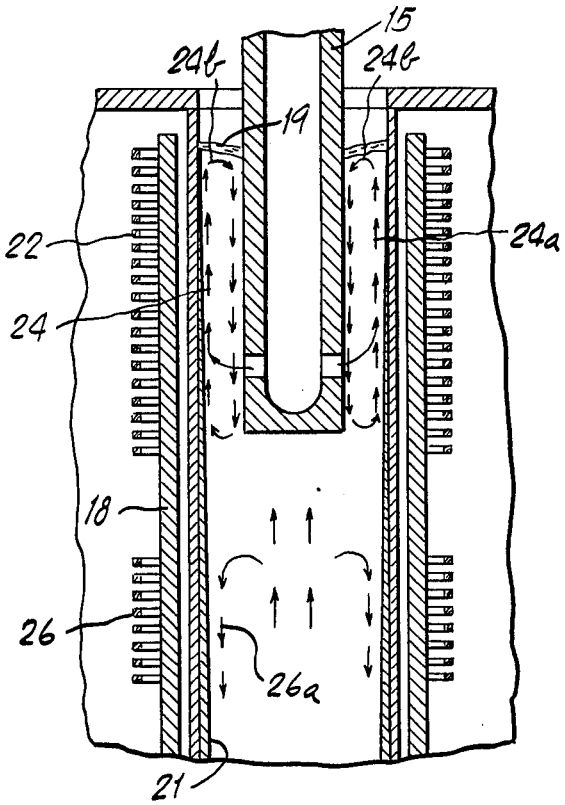
FIG. 3 is a view similar to FIG. 2 showing only the flow pattern caused by electromagnetically created circulation, and further illustrating provision of a second region of electromagnetically created circulation at a downstream locality in the mold.

FIG. 3 illustrates the circulation pattern created in the upper portion of the mold by the described induction stirring. In this pattern, the upward flow of metal (represented by arrows 24*a*) along the solid-liquid interface not only promotes upward flow of metal exiting from the shroud (as desired to carry entrained inclusions upwardly to the slag layer) but also constitutes a barrier that effectively prevents inclusions from reaching the mushy zone at the solid-liquid interface, where they would tend to become entrapped even when moving upwardly. Thus the inclusions, during their upward transport from the shroud exit ports to the slag layer, are kept in spaced relation to the interface by the sweeping upward current of molten metal represented by arrows 24*a*.

In addition, the electromagnetically created flow pattern inhibits entrapment of material of the slag layer at the solid-liquid interface. By promoting flow of hot introduced metal toward the slag layer, the described circulation helps to maintain the slag layer in a desirably hot and fluid condition. At the same time, the direction of metal flow at the locality where the slag layer most closely approaches the solid-liquid interface (represented by arrows 24*b*) tends to sweep slag material away from the upper extremity of the interface.

As stated, the location of the coils 22 should extend upwardly at least about to the slag-metal interface and downwardly to a locality below the shroud exit ports in order to ensure provision of the sweeping upward flow of metal along interface 21 through the entire region in which introduced inclusions and/or material of the slag might tend to become entrapped. It is presently preferred that the coils, in the embodiment of FIG. 1, extend from a level about 1 inch above the metal level in the mold to a point about 4 to 5 inches below the level end of the shroud 15.

Although the coils 24 are shown in FIG. 1 in combination with other features including the special shroud construction and inert gas injection arrangement further described below, the flow pattern resulting from electromagnetically created circulation in the upper part of the mold, when performed independently of use of these other features, is illustrated in FIG. 3.

Also shown in FIG. 3 is a second set of helical coils 26, again coaxially surrounding the mold 11 but spaced below the coils 24. The coils 26 may be employed if desired to provide, by induction stirring, further forced circulation of molten metal within the lower part of the mold, i.e. entirely below the shroud and adjacent the mold outlet end.

Specifically, the coils 26 are supplied with alternating current from a source (not shown) again such that the excitation of different portions of these coils in longitudinally successive regions differs successively in phase, the arrangement being such as to produce metal circulation in the paths indicated by arrows 26*a* in FIG. 3, i.e. downwardly adjacent the solid-liquid interface and then upwardly at the center of the mold. The considerations discussed above with reference to the selection of frequency for the current supplied to coils 24 are equally applicable to the current supplied to coils 26 since, as before, the conductive mold wall attenuates stirring power in a frequency-related way.

The described circulation created electromagnetically by passage of polyphase alternating current through the coils 26 aids in preventing defects in that part of the billet which solidifies within the mold and additionally serves to prevent sudden changes in the condition of the mushy zone at the solid-liquid interface as the billet emerges from the lowest part of the mold (where heat transfer is relatively inefficient) and enters the submold region where (in accordance with usual continuous casting practice) it is chilled with substantially enhanced efficiency of heat transfer by direct contact with sprays of a coolant such as water (not shown).

FIG. 7 illustrates, in somewhat simplified form, an alternative coil arrangement for the practice of the present invention. The copper mold 11, the submerged shroud 15, and non-magnetic stainless steel water cooling jacket 18 may be identical to the corresponding elements shown in FIG. 1; the cooling jacket, as illustrated, presents four flat vertical faces arranged in a square plan. In place of the helical coil 22 of FIG. 1, however, the apparatus of FIG. 7 includes four sets of so-called pancake-type induction stirring coils 27 respectively disposed adjacent the faces of the cooling jacket 18. Each of these coils, in the form shown, defines a plurality of horizontal current paths lying in a common vertical plane parallel to the plane of the adjacent jacket face, and distributed vertically over the same region (adjacent the mold) as the coils 22 of FIG. 1. Passage of polyphase alternating current through these pancake coils 27, from a suitable source (not shown), and in observance of the conditions described above with reference to FIG. 1, produces the pattern of molten metal circulation shown in the upper portion of FIG. 3, i.e. essentially the same molten metal flow pattern within the mold as is produced with the coils 22.

SHROUD

The shroud 15 of the present invention, in the embodiment of FIG. 1, is an axially vertical conduit structure connected at its upper end to the tundish 14 and projecting downwardly therefrom into the upper portion of the interior of the mold 11, being disposed in coaxial relation to the mold. An axial bore 28 formed in the shroud, communicating at its upper end with the interior of the tundish and at its lower end with the interior of the mold through a plurality of lateral exit ports 30, conducts molten metal from the tundish down into the mold. As will be understood, the shroud may be an effectively integral body fabricated of a material conventionally used for shrouds for continuous casting operations.

The bore 28 of the shroud tapers downwardly from its upper, inlet end to its lower or outlet end immediately above the exit ports so as to form a downwardly opening nozzle 32. Immediately below the nozzle is a plenum 34 from which the ports 30 open laterally, and immediately beneath the plenum is a terminal portion 36 of the shroud defining a well 38 opening upwardly toward and axially aligned with the nozzle. This well has an internal diameter greater than that of the nozzle, and a vertical dimension or depth equal to at least several times the diameter of the nozzle. The exit ports open obliquely upwardly, being preferably disposed several inches below the metal level in the mold.

More particularly, in a preferred construction in accordance with the invention, the exit ports are oriented with their geometric axes slanting upwardly at an angle of about 11° to about 15° to the horizontal, and the well depth is equal to at least about 4½ times the internal diameter of the outlet end of the nozzle. Preferably, the ratio of well diameter to nozzle diameter is at least about 1.5:1. In an illustrative specific example of dimension, for a shroud having an overall length of 34 inches and a uniform outer diameter of 4¾ inches (ignoring the enlarged top flange 39), the bore tapers from a diameter of 2¼ inches at the upper end to a diameter of 1¼ inches at the nozzle outlet end, and the well has an inner diameter of 2¼ inches. The exit ports, each 2 inches in diameter, have their centerlines disposed (at the outer surface of the shroud) 25 inches below the top of the shroud and about 6 to 7 inches below the metal level in the mold, while the well terminates (internally) 32½ inches below the top of the shroud.

Figure 4:
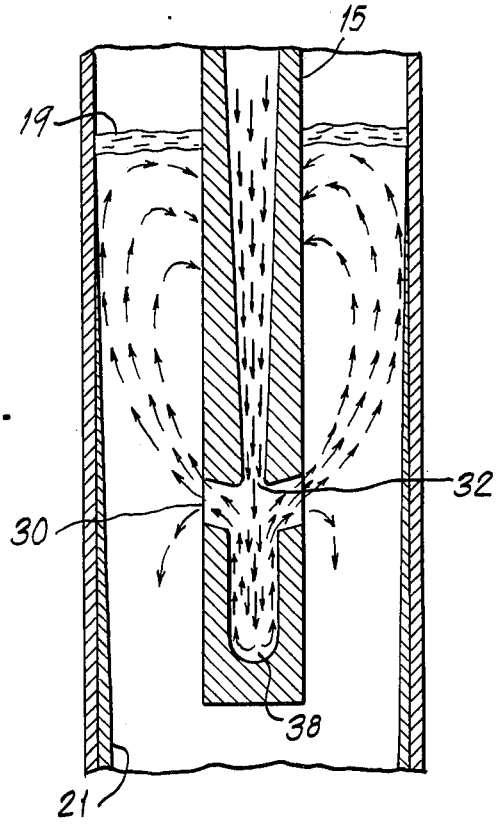
FIG. 4 is a view similar to FIG. 2 showing only the flow pattern created by the shroud structure of FIG. 1.

As used alone (i.e. apart from the electromagnetically created circulation described above), the step of delivering molten metal to the mold through this shroud structure produces the flow pattern shown in FIG. 4. The tapering nozzle directs the incoming metal down into the well, which defines a mixing zone and holding chamber to prevent violent splash-over of molten metal into the mold. This zone also desirably acts to allow inclusions in the molten metal to aggregate before entering the mold thereby permitting them to rise faster into the slag layer. Owing to the upward inclination of the ports, the outward flow of metal therethrough is directed somewhat upwardly (i.e. toward the slag layer, and away from the direction of casting), so that the inclusions tend to be carried up to the slag layer where they remain. Also, the upward flow of introduced hot metal heats the slag layer to maintain its fluidity, thereby reducing the likelihood of entrapment of inclusions from the slag layer at the solid-liquid interface of the metal in the mold. The combined effect of the tapered nozzle, well, and upwardly slanting ports is particularly effective in realizing this upward direction of metal flow in the mold.

A somewhat modified form of shroud structure is illustrated in FIG. 5. The main bore 42 of this modified shroud 44 tapers gradually (in a downward direction) from the top to the level of the ports, and contains a relatively short insert member 46 in its lower portion, which insert portion has a bore 48 with a relatively more pronounced downward taper to provide a constricted nozzle 50. In a specific example, the insert is fabricated of high density fused silica cemented in place with fused silica slurry before firing. The inner diameter of the main shroud bore tapers from 2½ inches at the top to 2¼ inches at the centerline of exit ports 52. Insert 46 has an axial length of 6 inches, with an outer diameter tapered to conform to the taper of the bore 42 in which it is mounted, and the inner diameter of insert bore 48 tapers from 1¾ inches at the top to 1¼ inches at the lower (outlet) end. Other dimensions are the same as in the example already set forth with reference to the embodiment of FIG. 1, including dimensions of well 53.

Figure 2:
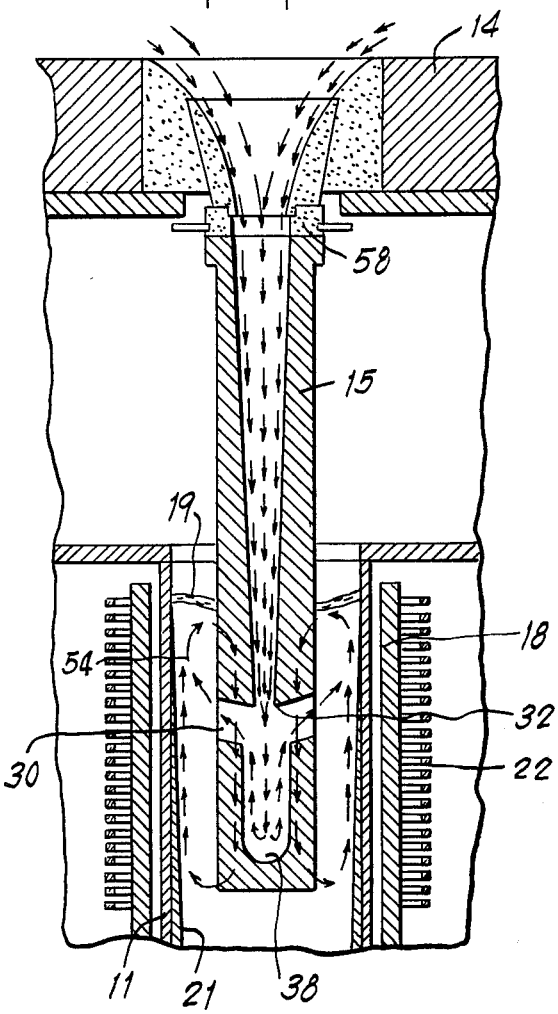
FIG. 2 is a simplified view, similar to FIG. 1, showing metal flow patterns in the FIG. 1 apparatus.

While the shroud of the invention may be employed alone (i.e. in an otherwise conventional continuous casting operation), as illustrated in FIG. 4, it is used with special advantage in conjunction with the provision of electromagnetically created circulation as described above, and cooperates therewith for attainment of reduced or minimized entrapment of inclusions in the cast billet. The metal flow pattern produced by such cooperation is represented by arrows 54 in FIG. 2. In addition, delivery of metal with this shroud is also advantageously combined with the feature of injecting inert gas, now to be described.

INERT GAS INJECTION

For injection of an inert gas into the molten metal flowing through the shroud 15, in accordance with the invention, a porous ceramic insert 58 is disposed for contact with the flowing metal at or adjacent the junction of the upper end of the shroud with the tundish 14, and inert gas (e.g. argon) is supplied to insert 58 through one or more conduits 60 under sufficient pressure to force the gas into the metal descending through the shroud. As shown in FIG. 1, the insert 58 may be in the form of a ring, having an external steel jacket (not shown), mounted between the outlet 62 of tundish 14 and the flange 39 at the upper edge of the shroud 15, and having its porous inner surface exposed to the flow of molten metal entering the shroud; alternatively, as illustrated schematically at 58*e* in FIG. 5, the insert may be set into an upper portion of the shroud itself.

In either case, the insert is disposed at or near the top of the shroud, i.e. sufficiently far above the exit ports thereof to enable the gas to disperse through the downwardly flowing metal in the form of fine bubbles before exiting into the mold. Thus, in the example of dimensions given above for the structure of FIG. 1, the gas is injected into the metal about 25 inches above the center line of exit ports 30.

As soon as these bubbles exit through the ports 30, they rise rapidly to the surface of the metal within the mold. The rising bubbles 66 serve as a vehicle for upward transport of inclusions 68 such as aluminum oxide particles, which are not wetted by molten steel and are therefore readily capable of being carried by the bubbles in the manner illustrated in FIG. 6. The provision of a plethora of inert gas bubbles, through injection as described above, accordingly promotes delivery of these inclusions into the slag layer as desired. In addition, the rising bubbles contribute to the desired upward flow of freshly delivered metal.

A further advantage of the described inert gas injection, as used either alone or in combination with the pressure conditions created by the tapered-nozzle shroud of FIG. 1 or 5 (i.e. when a shroud of that structure is employed together with gas injection), resides in the provision of pressure within the shroud that is at least slightly greater than ambient atmospheric pressure. This pressure differential effectively prevents aspiration of air, e.g. at the junction between the shroud and tundish, which would tend to cause undesirable oxidation in the metal.

To afford, for the bubbles within the mold, an upward path sufficiently long to enable them to provide the desired effect of upward transport of inclusions (and also to prevent disturbance of the slag layer by discharge of bubbles too close to that layer), the exit ports of the shroud should be disposed substantially below the metal level in the mold, for performance of the described injection of inert gas. A distance of six or seven inches between the metal level and the centerline of the ports, to which reference is made in the aforementioned example of dimensions, is illustrative of a suitable arrangement for this purpose.

By the injection feature of the present invention, the gas is (as stated) dispersed as fine bubbles through the molten metal in the shroud, and it is this dispersion that permits attainment of the described results. Conveniently, the gas employed is argon, supplied at a rate of e.g. several cubic feet per hour. Such gas injection, alone (i.e. using a generally conventional shroud), is found to produce significant reduction in the occurrence of inclusions in the ultimately cast billet. However, gas injection as herein contemplated is advantageously employed in conjunction with use of a shroud of the form shown in FIG. 1 or FIG. 5 (wherein the pressure drop created by the tapered nozzle cooperates with the supplied inert gas in maintaining a pressure greater than ambient within the shroud to prevent aspiration of air), and/or with provision of electromagnetically created circulation as described above, for cooperation in minimizing entrapment of inclusions at the solid-liquid interface of metal in the mold.

It is to be understood that the invention is not limited to the features and embodiments hereinabove specifically set forth but may be carried out in other ways without departure from its spirit.

We claim:

1. In the continuous casting of metal wherein the liquid metal is poured through a submerged shroud into a cooled mold through which the metal moves in one direction with an outer solidifying shell defining a solid-liquid interface within the mold and which is lined with electrically conductive material, said shroud having a closed bottom and delivering metal to exit outwardly into a region located in an upper portion of the mold, the procedure comprising:

a. pouring the metal through a slag layer in contact with the metal substantially upstream of said region; and electromagnetically circulating the metal in the mold by producing an alternating current field adjacent to the mold between approximately the slag-metal interface and a locality situated downstream of said outward exit, said alternating current being supplied to have at least two successively different phases in longitudinally successive regions to thereby provide circulation of the liquid metal in a direction generally opposite to said one direction along said solid-liquid interface from said locality to the slag layer and generally in said one direction along the outer surface of the shroud, said current being supplied at a frequency sufficiently high to move the metal in the described circulation and sufficiently low that effective metal-moving power is transmitted despite attenuation by said conductive lining such that the electromagnetically induced metal flow acts to positively sweep nonmetallic inclusions intrained in the outflow from the shroud along said solid-liquid interface in spaced relation thereto along the slag layer whereby removal of inclusions into the slag is promoted;

wherein the improvement comprises c. the pouring step comprising pouring the liquid metal through a shroud having a central bore tapering continuously throughout the entire length of the shroud in a downstream direction to constitute a nozzle, and into a well defined by the closed bottom of the shroud downstream of and opening toward the nozzle, for outward exit of metal to the mold through ports opening laterally through the shroud between the well and the nozzle and oriented at an obtuse angle to said one direction, while maintaining a metal level in the mold at least several inches above said ports; and d. injecting an inert gas into the liquid metal being poured through the shroud, at a locality upstream of said region, for dispersing the gas through the liquid metal in the form of fine bubbles prior to exit of the metal into the mold.

2. Procedure according to claim 1, wherein the depth of said well is at least about 4½ times the diameter of said nozzle and the diameter of said well is greater than that of said nozzle, and wherein said exit ports are oriented at an angle of about 11° to about 15° to a plane perpendicularly intersecting the axis of said bore.

3. Procedure according to claim 2, wherein said mold is axially vertical, said one direction is vertically downward, said frequency at which said alternating current is supplied is in the range of about 10 to about 35 Hz, and said gas is argon, injected at a rate sufficient to maintain the interior of the shroud at a pressure at least slightly higher than atmospheric pressure.

4. Procedure according to claim 1, wherein said gas is supplied at a rate sufficient to maintain the interior of the shroud at a pressure at least slightly higher than ambient atmospheric pressure.

5. Procedure according to claim 1, wherein said injecting step comprises supplying the inert gas to a porous member having a porous surface maintained in contact with the metal being poured adjacent the upper extremity of the shroud.

6. Procedure according to claim 1, wherein said gas is argon.

7. Apparatus for continuously casting metal, including a. a casting mold for receiving liquid metal, through which the metal moves in one direction with an outer solidifying shell, said mold being fillable with liquid metal at least to a predetermined level; and b. means operatively associated with the mold for cooling the mold;

wherein the improvement comprises:

c. a shroud operatively associated with the mold for delivering liquid metal to the mold from an external locality, said shroud extending into the mold in a downstream direction from an external locality for delivering metal to exit outwardly into a region of the mold downstream of said predetermined level, said shroud having i. a central bore tapering continuously throughout the entire length of the shroud in a downstream direction to constitute a nozzle;

ii. a closed extremity defining a well downstream of and opening toward the nozzle for receiving liquid metal discharging through the nozzle; and iii. a plurality of ports, for exit of delivered metal to the mold, opening laterally through the shroud between the well and the nozzle and oriented at an obtuse angle to said one direction;

d. means operatively associated with the mold for electromagnetically creating axially directed flow of liquid metal in the mold between a locality downstream of said region and a locality adjacent said predetermined level; and e. means operatively associated with the shroud for injecting an inert gas into liquid metal pouring through the shroud upstream of said nozzle to disperse the gas through the metal in the form of fine bubbles.

8. Apparatus as defined in claim 7, wherein the depth of said well is at least about 4½ times the diameter of the nozzle and the diameter of the well is greater than that of the nozzle.

9. Apparatus as defined in claim 8, wherein said exit ports are oriented at an angle of about 11° to about 15° to a plane perpendicular intersecting the axis of said bore.

10. Apparatus as defined in claim 9, wherein the diameter of the well is at least about 1.5 times the diameter of the nozzle.

* * * * *